United States Patent [19]

Striegel et al.

[11] Patent Number: 4,512,042

[45] Date of Patent: Apr. 23, 1985

[54] RAILING FOR SPA OR THE LIKE

[75] Inventors: William H. Striegel, Howards Grove; Willard H. Schmitz, Plymouth, both of Wis.

[73] Assignee: Kohler Co., Kohler, Wis.

[21] Appl. No.: 494,947

[22] Filed: May 16, 1983

[51] Int. Cl.[3] ..... E04H 3/16; E04H 3/18; E04H 3/19

[52] U.S. Cl. ..... 4/496; 4/511; 4/492

[58] Field of Search ..... 4/496, 492, 504, 506, 4/507, 511, 510; 138/149

[56] References Cited

U.S. PATENT DOCUMENTS

| | | | |
|---|---|---|---|
| 2,974,746 | 3/1961 | Baker | 4/490 X |
| 3,090,489 | 5/1963 | Smith | 4/496 X |
| 3,139,628 | 7/1964 | Richards | 4/496 |
| 3,463,691 | 8/1969 | Martin | 138/149 X |
| 3,559,694 | 2/1971 | Volberg | 138/149 X |
| 4,072,612 | 2/1978 | Daniel | 210/169 |
| 4,166,296 | 9/1979 | Darrah et al. | 4/496 |
| 4,193,143 | 3/1980 | DeCarvalho Vianna | 4/496 X |
| 4,238,859 | 12/1980 | Badon, Jr. | 4/492 X |
| 4,239,063 | 12/1980 | Long | 138/149 X |
| 4,268,386 | 5/1981 | May | 210/169 |

*Primary Examiner*—Henry K. Artis

*Attorney, Agent, or Firm*—Quarles & Brady

[57] ABSTRACT

A railing for a spa or the like is disclosed. In one embodiment, there is a tubular railing having an upwardly extending portion leading from an inlet, a downwardly extending portion leading to an outlet, and a cross portion connecting the upper ends of the upwardly and downwardly extending portions. The railing has an outer decorative tube and an inner insulating tube. The insulating tube is formed so as to permit the passage of air through the railing from the inlet to the outlet end. The railing provides a Hartford loop to protecting an air pump from the backflow of water from a spa, while at the same time hiding the connection between the pump and spa. The railing is also specially designed such that the grip portion of the railing does not become unacceptably hot due to air pumped through the railing.

1 Claim, 4 Drawing Figures

RAILING FOR SPA OR THE LIKE

BACKGROUND OF THE INVENTION

A. Field of the Invention

The present invention relates to hot tubs in which a vigorous stream of air is pumped into the water. It is especially useful for highly decorative tub installations where the air pump is to be housed in close proximity to the tub.

B. Description of the Art

In recent years, there has been an increasing interest in large bathing tubs which are commonly known as hot tubs or spas. These spas are filled with hot water to a level sufficiently high that a bather can be immersed in the water up to the neck while sitting upright in the tub. They are often large enough to accommodate several people, and they are generally marketed for home use and enjoyment. An especially important feature of these tubs is that they allow a vigorous stream of air to be pumped into the water so that the water provides a massaging action against the bather's skin.

A considerable portion of the expense involved in the construction of such spas goes into the support system associated with the spas. To minimize this cost, it is desirable to house the air pump and other spa support accessories as close as possible to the spa (thus eliminating much connecting piping and some of the costs of hiding the piping).

Spas designed for outdoor installation are often mounted in redwood surrounds which are large enough so as to provide some space between the outer walls of the spa and the inner walls of the surround for placement of the support system required for the operation of the spa. The surround will then serve to hide and protect accessories such as the pump, while cutting down on the length of piping that is required between the air pump and spa.

However, many safety codes require that when an air pump for a spa is connected by a pipe to the spa, the pipe must include a loop (a "Hartford" loop) which is of a sufficient height so as to make it exceedingly unlikely that water will be able to back up into the air pump from the spa. The required height of the loop is higher than the height of a conventional decorative spa surround.

Because of this, a spa designer would have to leave an exposed Hartford loop pipe somewhere around the tub above the surround (if the designer did not want to accept the cost of placing the air pump outside of the surround and some distance from the tub, or of constructing a separate housing for the Hartford loop). An exposed Hartford loop pipe is unsightly. Also, it raises an additional risk of accident (e.g., a user of the tub might trip over or bump against an exposed Hartford loop pipe). Thus, it can be seen that a need has existed for an improved way to protect an air pump that is housed in a spa surround from water backflows, without sacrificing the decorative appearance of the installation, incurring unnecessary costs, or exposing the tub user to an unnecessary risk of injury.

SUMMARY OF THE INVENTION

The present invention relates to a railing for a spa or the like that incorporates a "Hartford" loop. The railing is tubular and has an upwardly extending portion leading from an inlet, a downwardly extending portion leading to an outlet, and a cross portion connecting the upper ends of the upwardly and downwardly extending portions. At least a grip section of the railing has an outer decorative tube and an inner insulating tube. The insulating tube is designed so as to permit the passage of pumped air through the railing from the inlet end to the outlet end. The railing thus formed can be used as both a "Hartford" loop for the air pump (to prevent the backflow of water from the spa), and a railing to assist users of the spa in entering into and leaving the spa.

In an especially preferred embodiment, the outer decorative tube is preferably made of metal, and the inner insulating tube is preferably made of a plastic that can be formed separately from the metal tube and inserted therein. There is also a cover ring which bears axially against and covers the junction of the plastic insulating tube and metal outer decorative tube in the direction of air flow to restrict the entry of air therebetween. A guide sleeve is formed integrally with the cover ring and inserted into the inlet end of the insulating tube. The sleeve guides air into the insulating tube, limits the inward movement of the insulation away from the outer tube, and covers the radially inward junction between the cover ring and insulating tube.

It should be appreciated that the two layer structure of the grip section of the railing is an important feature of the invention. For decorative purposes, highly polished metals (e.g. chrome or stainless steel) are very desirable. However, such metals, by themselves, are unacceptable for use as combined Hartford loops and handrails. This is because when a stream of air is vigorously pumped through a metallic pipe, even when the air is not heated, the friction of the air in a metal pipe causes a surprisingly great heating of the pipe. The conductive characteristics of the metal then transmit this heat to the exterior of the pipe. The shock of a very hot railing grip is not only unpleasant, it could surprise a user enough such that the user could slip and fall on the wet spa rim just as a user is reaching for support.

The applicants have found that materials which do not exhibit this tendency (e.g. insulating plastics) have proven to be unacceptable for decorative or structural reasons, or are unacceptable because they cannot be exposed to water on a continual basis. The present invention therefore provides a two tube structure, at least in the vicinity of the railing grip. Thus, heat will not be transmitted to the grip to the point that a user feels discomfort. At the same time, the metal outer tubing provides a decorative appearance. An important benefit of this construction is that it can be manufactured very inexpensively.

However, even with this construction, there can be problems on occassion if the inner tube is not perfectly fitted into the outer tube. Thus, the cover ring and guide sleeve referred to above cleverly prevent the vigorous stream of air from pushing its way between the insulating tube and the outer decorative tube (and thus defeating the insulation) or dislodging the inner tube. At the same time, they allow very inexpensive assembly techniques to be used.

The objects of the invention therefore include:

(a) providing a railing for a spa or the like of the above kind which protects an air pump against backflow of water from the spa by serving as a Hartford loop;

(b) providing a railing for a spa or the like of the above kind which prevents the grip portion of the railing from reaching unacceptably hot temperatures by virtue of pumped air passing through the railing; and (c) providing a railing for a spa or the like of the above kind which is inexpensive to manufacture and install.

These and still other objects and advantages of the present invention will be apparent from the description which follows. The following description of the preferred embodiment of the invention will be disclosed with reference to the accompanying drawings. These embodiments do not represent the full scope of the invention. Rather, the invention may be employed in other embodiments. Reference is therefore to be made to the claims herein for interpreting the scope of the present invention.

DESCRIPTION OF THE PREFERRED EMBODIMENT

Figure 1:
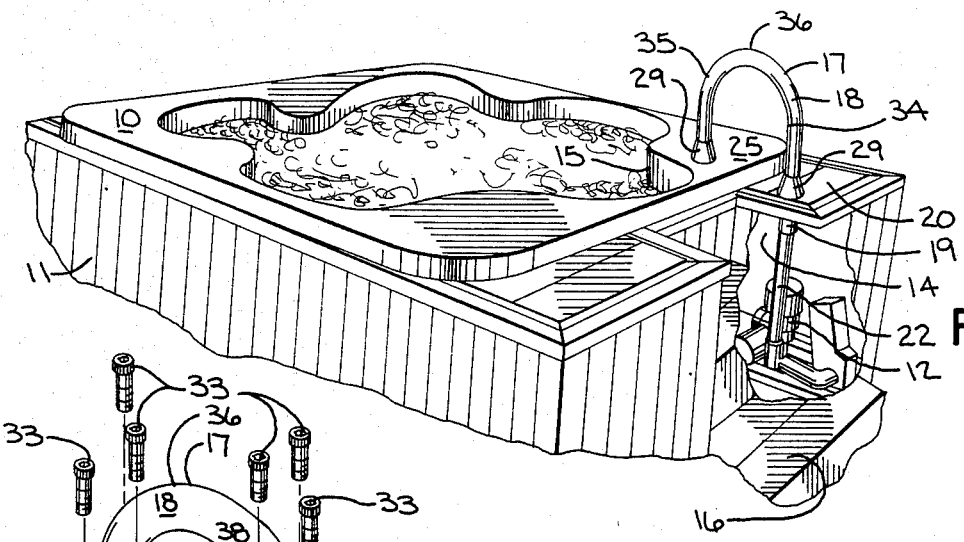
FIG. 1 is a perspective view of a spa which has been mounted in a redwood spa surround, a portion of the surround being broken away.
Figure 2:
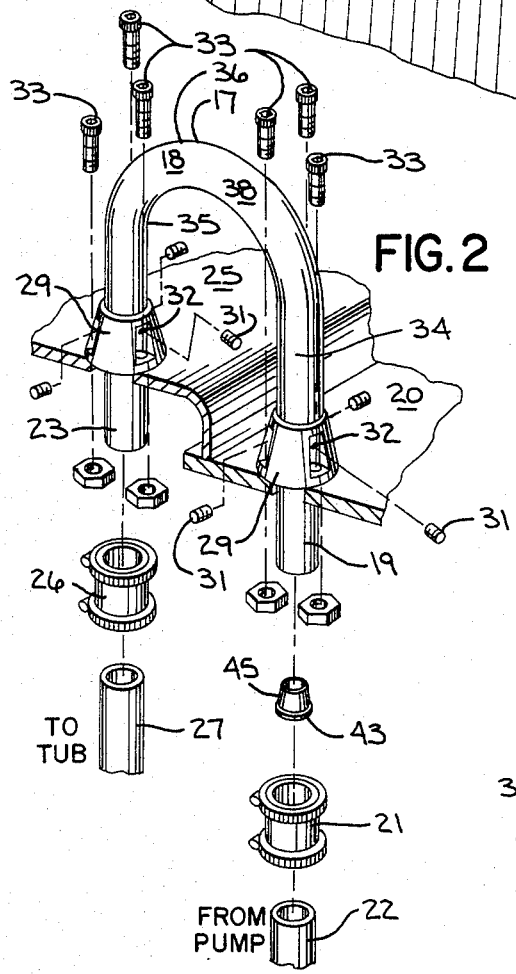
FIG. 2 is an enlarged exploded perspective view of the spa railing shown in FIG. 1.
Figure 3:
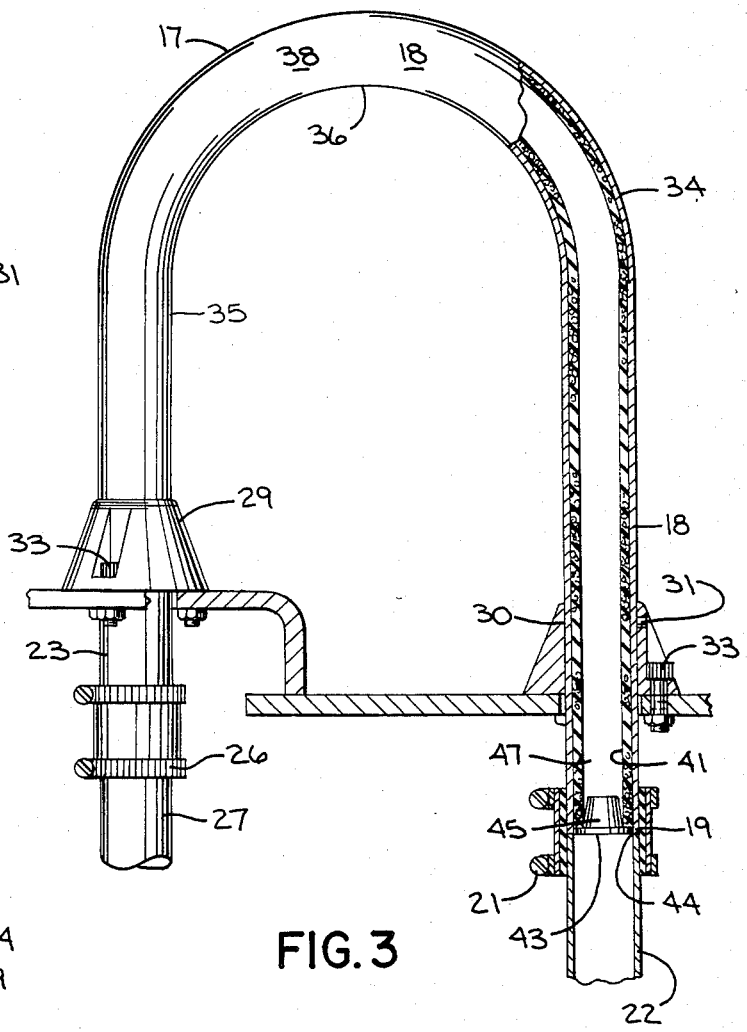
FIG. 3 is a partial sectional view through the spa railing.
Figure 4:
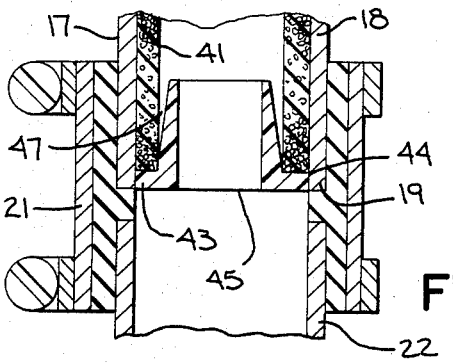
FIG. 4 is a detailed sectional view of the cover ring and guide sleeve portion of the spa railing.

Turning now to the drawings, FIG. 1 shows a spa 10 which has been mounted in a redwood spa surround 11. An air pump 12 is housed and concealed between the inner wall 14 of the redwood surround and wall 15 of the spa 10. Steps 16 are provided to allow a user to climb up to the top of the spa 10.

Adjacent to the steps 16 is a hand railing 17 which is formed in accordance with the present invention. The railing 17 is generally tubular in shape, and has a stainless steel outer decorative tube 18. The inlet end 19 of the railing 17 extends through the top wall 20 of the spa surround 11. It is connected via a connecting hub 21 to pipe 22 which leads from the air pump 12. Outlet 23 of the railing 17 extends through the top wall 25 of the spa 10. It connects via a connecting hub 26 to a pipe 27 which leads to the spa 10.

The railing 17 is fixed in position with respect to the surround 11 and spa 10 by use of anchoring escutcheons 29. These escutcheons have a central axial bore 30 which is of a diameter only slightly larger than the outer diameter of the railing 17. Thus, the railing 17 can be inserted through the escutcheon 29 and side set screws 31 can then be inserted radially through holes 32 in the escutcheon 29 against the railing. This will affix each escutcheon to the railing. Another group of screws 33 can then be inserted through the escutcheons 29 into the spa surround top 20 and spa top 25. Using suitable bolts, these screws can then hold the railing against vertical movement.

The railing 17 has an upwardly extending portion 34 leading from the inlet 19, a downwardly extending portion 35 leading to the outlet 23, and a cross portion 36 connecting the upper ends of the upwardly and downwardly extending portions. In the embodiment shown in FIG. 1, the cross portion 36 constitutes a grip section 38 of the railing.

The grip section 38 is formed from a part of the outer decorative metallic tube 18 and a part of the inner plastic insulating tube 41. The insulating tube 41 is formed so as to permit the passage of air through the railing 17 from the inlet 19 to the outlet 23. It will thus be appreciated that air pumped from the air pump 12 will pass through the railing 17 and to the spa 10, with the railing acting as a Hartford loop.

There is also provided a cover ring 43 which bears against the insulating tube 41 and the junction 44 between the insulating tube 41 and the outer decorative tube 18 in the direction of air flow. This restricts the entry of air therebetween. Guide sleeve 45 is formed integrally with the cover ring 43, and is inserted in the inlet end 47 of the insulating tube 41. This sleeve 45 directs air into the insulating tube 41 (and thus away from the junction 44 of the insulating tube 41 and the outer decorative tube 18). It also limits the inward movement of the insulation away from the outer tube 18, and covers the radially inward junction between the cover ring and insulation. To secure the cover ring 43 in place, a sealant such as GE silicon sealant can be used.

The insulating tube 41 is formed from a bendable insulating plastic (e.g. a material known as Rubatex which is commercially available from Bay Insulation Supply Co.) which can be formed separately from the metallic tube and then inserted therein. The outer tube 18 is preferably formed of stainless steel. The plastic insulating material is formed into a tube of only slightly less diameter than the interior diameter of the metal tube.

This construction has proved very advantageous for reducing manufacturing costs. In this regard, one can take a conventional metal pipe, and bend it or otherwise form it into the railing shape. Then, a lubricating powder can be sprayed onto the tube 18. The insulating tube can then be drawn through the piping by use of a metal wire that is hooked onto the tubing and projected through the railing. (With appropriate materials one might also be able to push the plactic tube through the metal railing.)

Because of the use of the cover ring and sleeve, it is not critical that there be a tight fit between the insulating tube and the metal outer tube, for the cover ring and guide sleeve will retain the inner tube 41 in place, and will prevent air from leaking between the insulating tube 41 and outer tube 18.

Thus, it will be appreciated that the present invention minimizes the likelihood of damage to the air pump, without ruining the decorative appearance of the spa installation or exposing the user to an unnecessary additional risk of accident (many spas already have a conventional railing). The invention also provides a practical means of constructing a decorative railing which will not expose the user to unacceptable heat in the region of the grab rail.

Although the especially preferred embodiment of the invention has been described above, it should be noted that the invention is not so limited. In this regard, there may be various other modifications and changes to this embodiment which are within the scope of the invention. For example, it is not necessary that the railing be U-shaped as in FIG. 1. Instead, the railing might have a straight upward leg, a straight cross piece at a 90 degree angle to the upward leg and a straight downward leg. Also, a "tubular" railing need not be circular in cross section. A square railing having a central conduit would be sufficiently tubular. Another possibility is that to save insulation material, the insulation is only used at the grip section. Such modifications and other modifications are meant to be within the scope of the invention. The invention is therefore not to be limited by the illustrative description above.

I claim:

1. A railing for a spa or the like, comprising:

a tubular railing having an upwardly extending portion leading from an inlet, a downwardly extending portion leading to an outlet, and a cross portion connecting the upper ends of the upwardly and downwardly extending portions;

at least a grip section of said railing comprising an outer decorative tube and a flexible inner insulating tube;

said insulating tube having been formed separately from the outer decorative tube and then having been positioned therein so as to permit the passage of air through the insulating tube, from its inlet end to its outlet end;

a cover ring which bears axially against and covers the junction of the insulating tube and the outer decorative tube in the direction of air flow to restrict the entry of air therebetween; and a guide sleeve extending from said cover ring and inserted in the inlet end of the insulating tube to guide air into the insulating tube;

whereby the sleeve limits the inward movement of the inlet end of the flexible insulating tube away from the outer tube, and covers a radially inward junction between the cover ring and insulating tube.

* * * * *